US006523692B2

(12) United States Patent
Gregory

(10) Patent No.: US 6,523,692 B2
(45) **Date of Patent: *Feb. 25, 2003**

(54) FOLD-IN-HALF SHIPPING/DISPLAY BOX

(75) Inventor: James W. Gregory, Van Buren, AR (US)

(73) Assignee: Fort James Corporation, Deerfield, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/414,714

(22) Filed: Oct. 12, 1999

(65) Prior Publication Data

US 2001/0001447 A1 May 24, 2001

Related U.S. Application Data

(60) Provisional application No. 60/103,906, filed on Oct. 13, 1998.

(51) Int. Cl.[7] ..... B65D 25/04

(52) U.S. Cl. ..... 206/746; 206/750

(58) Field of Search ..... 206/736, 738, 206/746, 815, 747, 750, 769, 745; 229/240, 120.012, 120.09, 235; 211/72, 73; 29/401.1

(56) References Cited

U.S. PATENT DOCUMENTS

| | | | | |
|---|---|---|---|---|
| 776,042 A | | 11/1904 | Acheson | |
| 2,020,876 A | | 11/1935 | Clark et al. | |
| 2,131,391 A | | 9/1938 | Schraffenberger | |
| 2,152,079 A | | 3/1939 | Mott | |
| 3,002,613 A | | 10/1961 | Merkel et al. | |
| 3,090,483 A | | 5/1963 | Altree et al. | |
| 3,139,979 A | * | 7/1964 | Russell | 206/746 |
| 3,280,968 A | | 10/1966 | Craine | |
| 3,653,495 A | | 4/1972 | Gray | |
| 3,884,348 A | | 5/1975 | Ross | |
| 4,467,923 A | | 8/1984 | Dornbusch et al. | |
| 4,793,487 A | | 12/1988 | Bentsen et al. | |
| 4,905,837 A | | 3/1990 | Schuster et al. | |
| 5,181,650 A | | 1/1993 | Hollander et la. | |
| 5,657,872 A | * | 8/1997 | Leftwich et al. | 206/738 |
| 5,921,398 A | | 7/1999 | Carroll | |
| 5,927,498 A | | 7/1999 | Saam | |
| 6,129,211 A | * | 10/2000 | Prakken et al. | 206/750 |

FOREIGN PATENT DOCUMENTS

| | | |
|---|---|---|
| EP | 0 726 205 | 8/1996 |
| FR | 2 669 893 | 6/1992 |

* cited by examiner

*Primary Examiner*—Jim Foster
(74) *Attorney, Agent, or Firm*—Burns, Doane, Swecker & Mathis, LLP

(57) ABSTRACT

A fold-in-half shipping/display box has tear-away segments in its front side, and severable perforations in the top and rear walls, whereby once the tear-away segments have been removed and the perforations have been severed, the box can be folded in half to display items contained therein.

7 Claims, 3 Drawing Sheets

FOLD-IN-HALF SHIPPING/DISPLAY BOX

RELATED APPLICATION

This invention is disclosed in Provisional Application Ser. No. 60/103,906, filed Oct. 13, 1998.

BACKGROUND OF THE INVENTION

The present invention relates to a shipping/display box which can be used for shipping items to a store and then displaying the items in the store, and to a method of converting a box from a shipping mode to a display mode.

It is conventional to employ a box, such as a corrugated cardboard box, for shipping items to a store and then as a display container within the store. For example, each of U.S. Pat. Nos. 3,002,613, 4,793,487 and 5,927,498 discloses a box containing two rows of articles. The box includes a tear-away strip that extends around three sides of the box. Once the tear-away strip has been removed, a remaining fourth side forms a fold axis about which the box can be folded to produce two side-by-side compartments containing respective rows of articles.

However, a tear-away strip which extends continuously around three sides of a box serves to considerably weaken the box, whereby the box is less able to withstand external forces during shipment. Also, the resulting compartments are open only at their tops, making it difficult for a shopper to notice and identify the particular articles.

It would be desirable to provide a fold-in-half display box which exhibits improved strength for shipping and stacking and yet is able to expose front sides of the articles being displayed.

SUMMARY OF THE INVENTION

The present invention relates to a fold-in-half shipping/display box comprising a horizontal top side, a horizontal bottom side, parallel front and rear vertical sides interconnecting the top and bottom sides, and parallel end sides interconnecting the top and bottom sides. The front side intersects the top and bottom sides along a top front edge and a bottom front edge, respectively, of the box. The rear side intersects the top and bottom sides along a top rear edge and a bottom rear edge, respectively, of the box. The front side includes a tear-away portion having upper and lower edges coinciding with the top front edge and the bottom front edge, respectively. The rear side and the top side have a perforated line formed therein, the perforated line including a first section extending within the rear side perpendicularly from the bottom rear edge to the top rear edge, and a second section extending within the top side perpendicularly from the top rear edge to the top front edge. The bottom side includes a fold line extending perpendicularly from the bottom rear edge to the bottom front edge. The perforated line and the fold line lie in a common vertical plane bisecting the box. When the tear-away portion is removed, and the perforated line has been severed, and the bottom side has been folded in half along the fold line, the box presents a pair of side-by-side compartments separated by the folded-in-half bottom wall and resting on respective ones of the end sides.

The invention also pertains to the method of converting that box from a shipping mode to a display mode.

BRIEF DESCRIPTION OF THE DRAWING

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
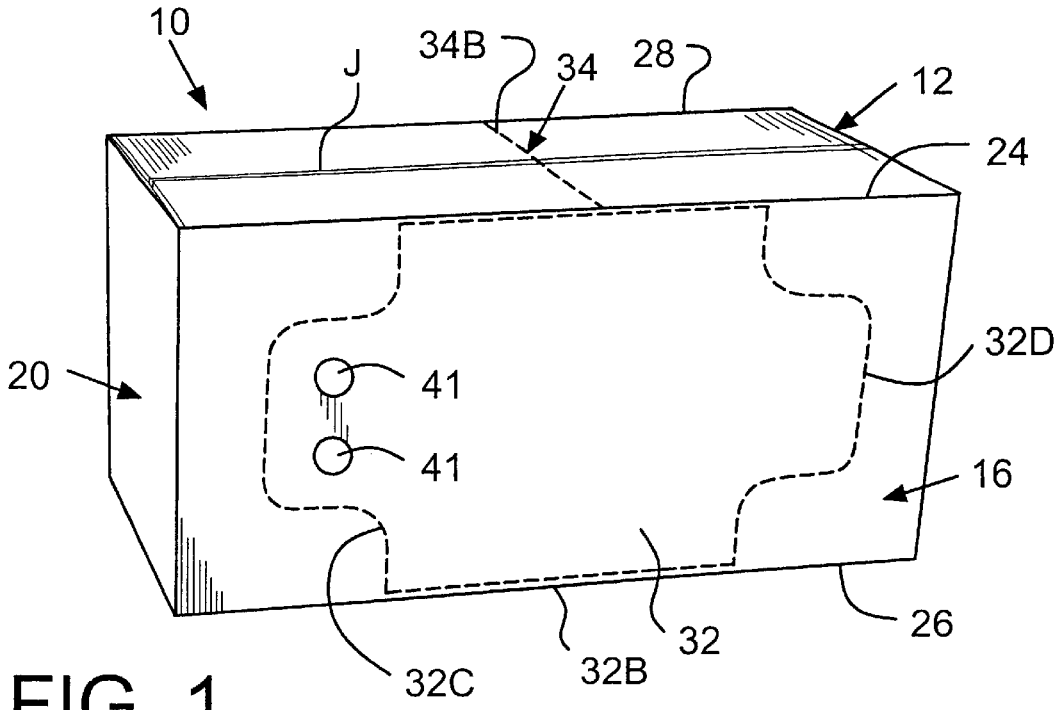
FIG. 1 is a top front perspective view of a shipping/display box in a shipping state, according to the present invention.
Figure 2:
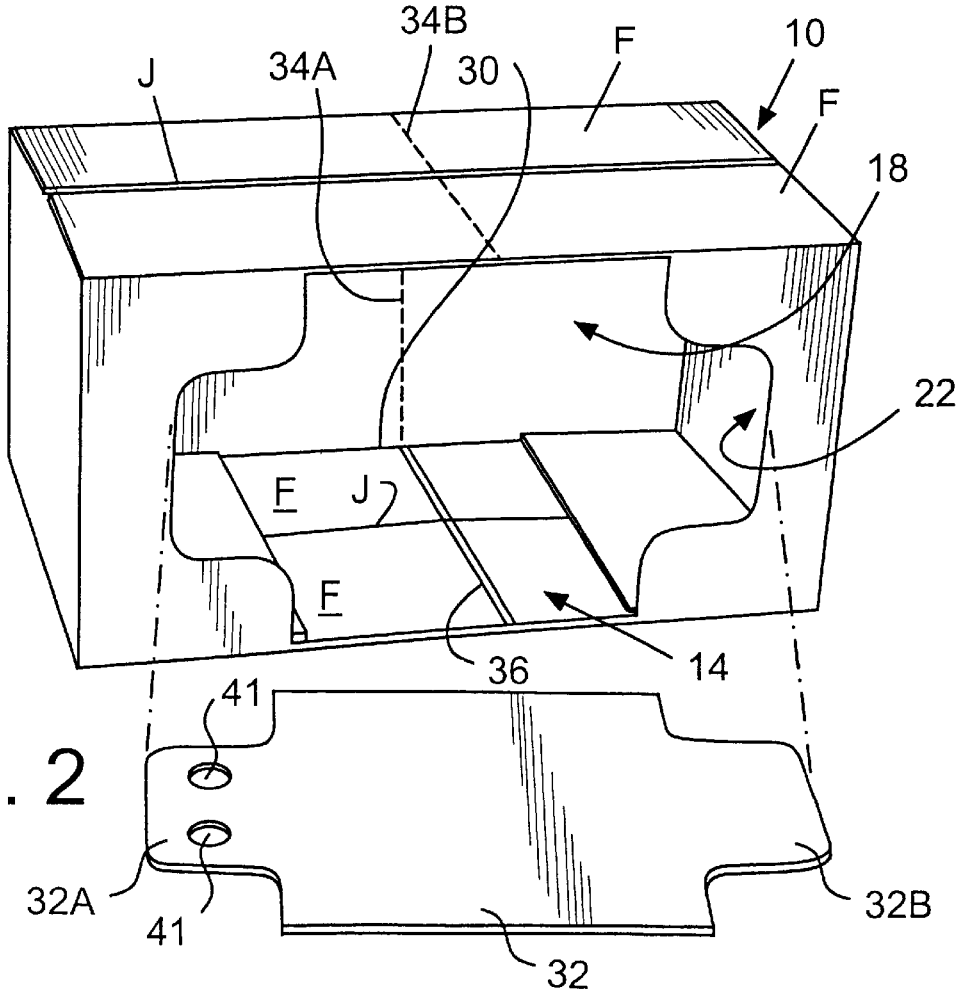
FIG. 2 is a view similar to FIG. 1 after a tear-away portion has been removed from the box.

A fold-in-half shipping/display box 10 depicted in FIG. 1 is formed of a single piece of corrugated cardboard to form a horizontal top side 12, a horizontal bottom side 14, parallel front and rear vertical sides 16, 18 interconnecting the top and bottom sides 12, 14 and parallel end sides 20, 22 interconnecting the top and bottom sides 12, 14. The front side 16 intersects the top and bottom sides 12, 14 along a top front edge 24 and a bottom front edge 26, respectively, of the box. The rear side 18 intersects the top and bottom sides 12, 14 along a top rear edge 28 and a bottom rear edge 30, respectively, of the box.

Figure 3:
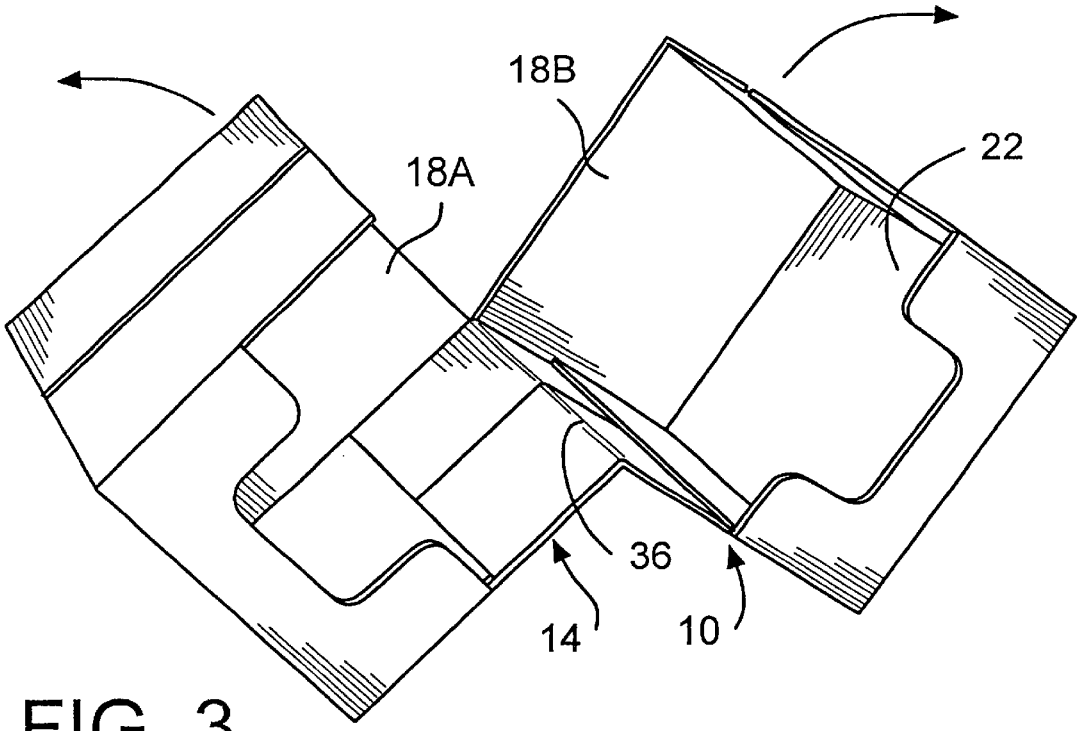
FIG. 3 is a view similar to FIG. 2 as the box is being folded in half.
Figure 4:
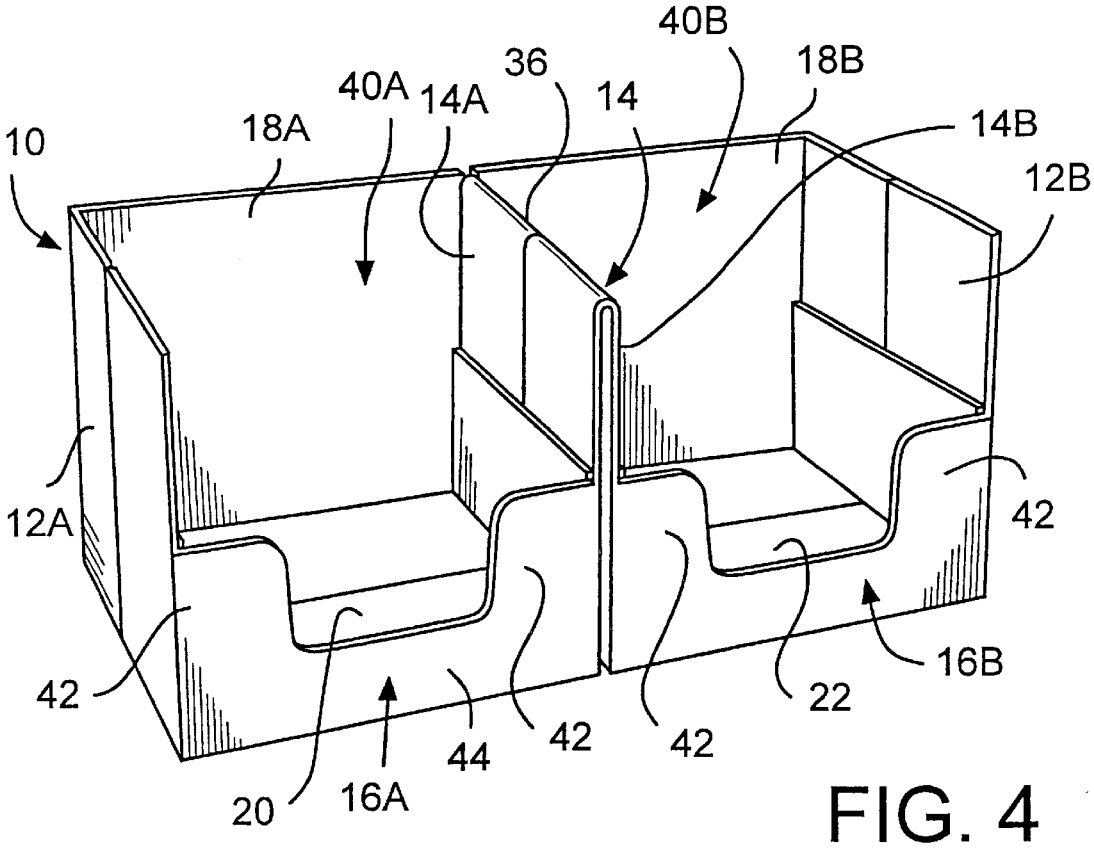
FIG. 4 is a view similar to FIG. 3 after the box has been folded in half.

The front side 16 includes a tear-away portion 32 having upper and lower edges 32*a*, 32*b* coinciding with the top front edge 24 and the bottom front edge 26, respectively. The tear-away portion further includes first and second side edges 32*c*, 32*d* disposed in the front side 16. Each of the first and second side edges interconnects the upper and lower edges and terminates at the upper and lower edges, wherein the tear-away portion lies entirely in the front side 16. The rear and top sides 18, 12 include a perforated line 34 having a first section 34A extending perpendicularly from the bottom rear edge 30 to the top rear edge 28, and a second section 34B extending perpendicularly from the top rear edge 28 to the top front edge 24. The bottom side 14 includes a pre-creased fold line 36 extending perpendicularly from the bottom rear edge 30 to the bottom front edge 26. The perforated line 34 and the fold line 36 lie in a common vertical plane bisecting the box. With the tear-away portion 32 removed, and the perforated line 34 severed, and the bottom side 14 folded in half along the fold line 36, the box presents a pair of side-by-side compartments 40A, 40B separated by the folded-in-half bottom wall 14 and resting on respective ones of the end sides 20, 22 (see FIGS. 3 and 4).

Each compartment is thus formed by: a remaining portion 16A or 16B of the front side 16, one half 12A or 12B of the top side 12, one half 18A or 18B of the rear side 18, one half 14A or 14B of the bottom side 14, and one of the end sides 20 or 22.

The tear-away portion 32 includes a center portion have a height equal to a height of the front side 16, and a pair of tongues 32A, 32B projecting horizontally in opposite directions. Those tongues are of shorter height than the front side 16 and are spaced from the top front edge 24, the bottom front edge 26, and the end sides 20, 22, whereby after the box has been folded in half the front side forms two upstanding flanges 42 and a horizontal flange 44 disposed at the front of each compartment 40A, 40B for retaining articles therein. One of the tongues 32A has finger holes 41 formed therein to facilitate removal of the tear-away portion.

Figure 5:
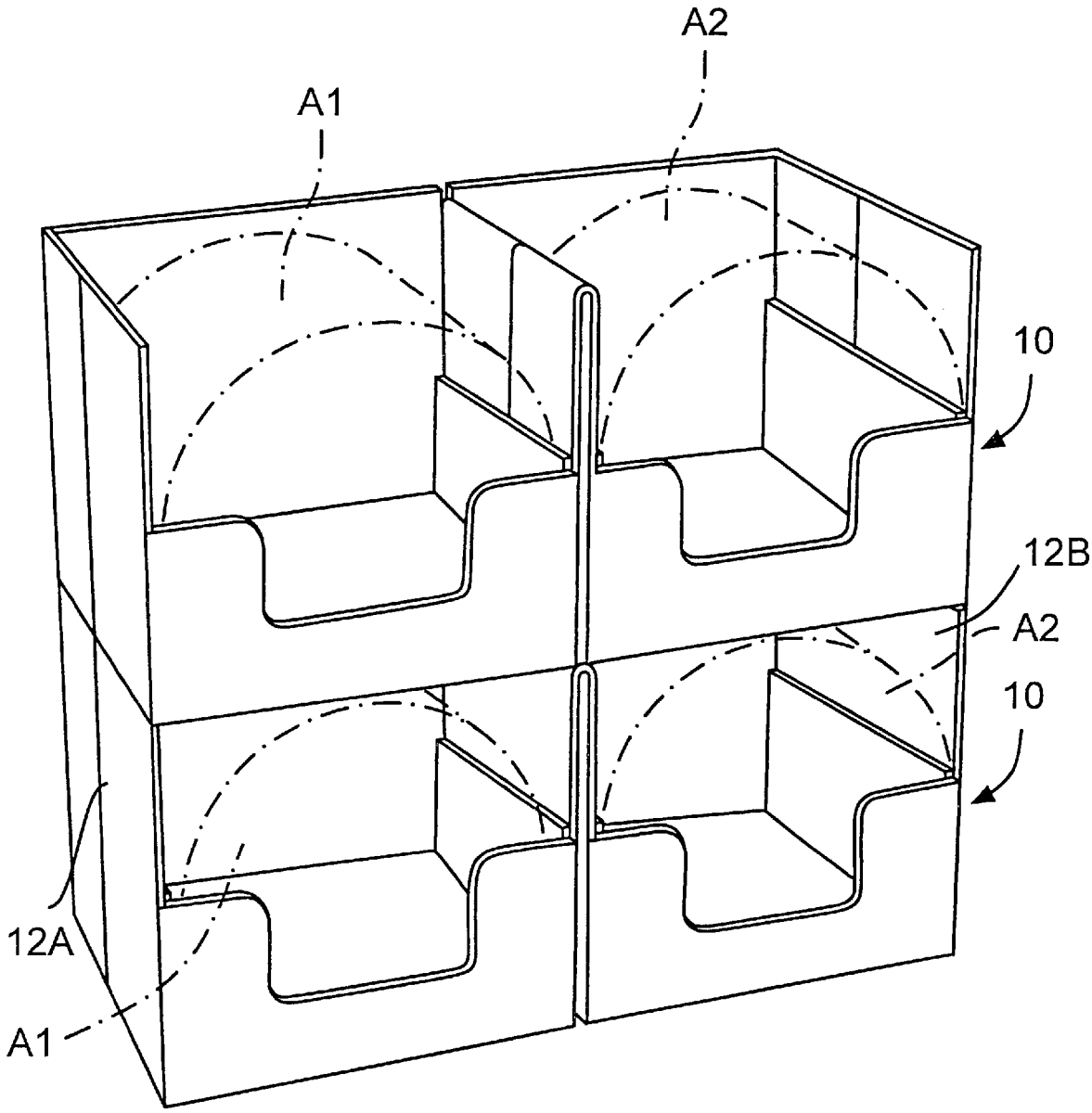
FIG. 5 is a view of two folded-in-half boxes mounted on upon the other, with articles depicted therein in phantom lines.

It will be appreciated that the articles are loaded into box 10 in two rows A1, A2 of articles (see FIG. 5).

FIG. 5 depicts two of the boxes 10 stacked one upon the other in a display mode. It will be appreciated that the halves 12A, 12B of the original top side 12 now form upstanding walls which aid in supporting the load of any other box(es) stacked thereon.

In the preferred embodiment, each of the top and bottom sides 12, 14 is formed of a pair of flaps F which form a joint J after they have been folded. After the box has been loaded, the joints are covered by tape (not shown).

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A fold-in-half shipping/display box comprising:

a horizontal top side, a horizontal bottom side, parallel front and rear vertical sides interconnecting the top and bottom sides, and parallel end sides interconnecting the top and bottom sides;

the front side intersecting the top and bottom sides along a top front edge and a bottom front edge, respectively, of the box;

the rear side being a one piece panel intersecting the top and bottom sides along a top rear edge and a bottom rear edge, respectively, of the box;

the box further including a tear-away portion formed by upper and lower edges coinciding with the top front edge and the bottom front edge, respectively, and first and second side edges disposed in the front side, each of the first and second side edges interconnecting the upper and lower edges and terminating at the upper and lower edges, wherein the tear-away portion lies entirely in the front side, the tear-away portion lying in a single plane which includes the upper and lower edges and the first and second side edges;

the rear side and the top side having a perforated line formed therein, the perforated line including a first section extending within the rear side perpendicularly from the bottom rear edge, and a second section extending within the top side perpendicularly from the top rear edge of the top front edge;

the bottom side including a fold line extending perpendicularly from the bottom rear edge to the bottom front edge;

the perforated line and the fold line lying in a common vertical plane bisecting the box, whereby with the tear-away portion removed, the perforated line severed, and with the bottom side folded in half along the fold line, the box presents a pair of side-by-side compartments separated by the folded-in-half bottom wall and resting on respective ones of the end sides.

2. The shipping/display box according to claim 1 wherein the box is formed of corrugated cardboard.

3. The shipping/display box according to claim 1 wherein the tear-away portion includes at least one through-hole formed therein for facilitating manual tearing-away of the tear-away portion.

4. The shipping/display box according to claim 1 wherein the tear-away portion includes a center portion having a height corresponding to a height of the front side, and a pair of tongues projecting horizontally at respective vertical edges of the tear-away portion, each tongue being of shorter height than the front side.

5. The shipping/display box according to claim 1 wherein the tear-away portion consists of a single piece bordered by said upper and lower edges and said first and second side edges.

6. A method of converting a shipping/display box from a shipping mode to a display mode for displaying articles contained in the box, the box comprising a horizontal top side, a horizontal bottom side, parallel front and rear vertical sides interconnecting the top and bottom sides, and parallel end sides interconnecting the top and bottom sides; the front side intersecting the top and bottom sides along a top front edge and a bottom front edge, respectively, of the box; the rear side being a one piece panel intersecting the top and bottom sides along a top rear edge and a bottom rear edge, respectively, of the box; the front side including a tear-away portion having upper and lower edges coinciding with the top front edge and the bottom front edge, respectively, the tear-away portion lying in a single plane which includes the upper and lower edges; the rear side and the top side having a perforated line formed therein, the perforated line including a first section extending within the rear side perpendicularly from the bottom rear edge to the top rear edge, and a second section extending within the top side perpendicularly from the top rear edge to the top front edge; the bottom side including a fold line extending perpendicularly from the bottom rear edge to the bottom front edge; the perforated line and the fold line lying in a common vertical plane bisecting the box; the method comprising the steps of:

A) removing the single-plane tear-away portion;

B) severing the rear side and top side in half along the perforated line; and

C) folding the bottom side in half along the fold line;

D) whereby the box presents a pair of side-by-side compartments separated by the folded-in-half bottom wall and resting on respective ones of the end sides, and wherein each compartment has a one-piece rear side.

7. The method according to claim 6 wherein step A further comprises removing said tear-away portion in a single piece along side upper and lower edges.

* * * * *